US009771189B2

(12) United States Patent
Miksovsky et al.

(10) Patent No.: US 9,771,189 B2
(45) Date of Patent: Sep. 26, 2017

(54) WATER BOTTLE CAP

(71) Applicant: humangear, inc., San Francisco, CA (US)

(72) Inventors: Christopher A. Miksovsky, San Francisco, CA (US); Elliot Sather, San Francisco, CA (US); Scott Cook, Oakland, CA (US); Thomas Zipprian, San Francisco, CA (US)

(73) Assignee: humangear, Inc., San Francisco, CA (US)

( * ) Notice: Subject to any disclaimer, the term of this patent is extended or adjusted under 35 U.S.C. 154(b) by 0 days.

(21) Appl. No.: 15/090,969

(22) Filed: Apr. 5, 2016

(65) Prior Publication Data

US 2017/0107023 A1 Apr. 20, 2017

Related U.S. Application Data

(63) Continuation-in-part of application No. 29/542,403, filed on Oct. 14, 2015, and a continuation-in-part of application No. 29/542,404, filed on Oct. 14, 2015, and a continuation-in-part of application No. 29/542,405, filed on Oct. 14, 2015, now Pat. No. Des. 767,390.

(51) Int. Cl.

| | |
|---|---|
| ***B65D 47/12*** | (2006.01) |
| ***B65D 51/18*** | (2006.01) |
| ***B65D 55/16*** | (2006.01) |

(52) U.S. Cl.

CPC ..... *B65D 47/122* (2013.01); *B65D 51/18* (2013.01); *B65D 55/16* (2013.01); *B65D 2251/0015* (2013.01); *B65D 2251/0078* (2013.01)

(58) Field of Classification Search

CPC ..... B65D 47/122; B65D 47/12; B65D 47/06; B65D 41/04; B65D 25/48; B65D 51/18; B65D 51/24; B65D 55/16; A47G 19/2272

USPC ..... 215/306, 228, 329, 316; 220/375, 212, 220/259.4, 259.3, 256.1, 254.8, 254.1; 222/568, 567, 566, 562, 545

See application file for complete search history.

(56) References Cited

U.S. PATENT DOCUMENTS

| | | | |
|---|---|---|---|
| 2,155,329 | A | 4/1939 | Perdue |
| D174,205 | S | 3/1955 | Ward |
| D185,179 | S | 5/1959 | Tupper |
| D193,121 | S | 6/1962 | Wickman |
| 3,181,725 | A | 5/1965 | Friedl |
| D221,886 | S | 9/1971 | Gruett |

(Continued)

OTHER PUBLICATIONS

Images of an Evive Station Water Bottle and Cap, prior to 2015.

(Continued)

*Primary Examiner* — Robert J Hicks

(74) *Attorney, Agent, or Firm* — Beyer Law Group LLP

(57) ABSTRACT

A water bottle cap system combination that can be used with wide mouth water bottles or mason jars. The water bottle cap system includes a large cap portion and a small cap portion, which are coupled by a flexible strap. The small cap portion can be screwed onto the spout of the large cap portion, which is screwed onto the water bottle or mason jar. The small cap portion can be unscrewed from the spout and temporarily attached to the strap so that the small cap portion is out of the way of the spout, but still attached to the water bottle cap system, during drinking or pouring from the water bottle.

24 Claims, 20 Drawing Sheets

(56) References Cited

U.S. PATENT DOCUMENTS

| | | | | |
|---|---|---|---|---|
| D280,802 | S | 10/1985 | Cho | |
| 6,478,180 | B1 | 11/2002 | Dehn | |
| D478,005 | S | 8/2003 | Sali | |
| D528,910 | S | 9/2006 | Kingsley | |
| D530,200 | S | 10/2006 | Kingsley | |
| D569,458 | S | 5/2008 | Nelson et al. | |
| D587,569 | S | 3/2009 | Eveleth | |
| D605,942 | S | 12/2009 | Miksovsky | |
| 8,752,720 | B1 * | 6/2014 | Habig | B65D 55/16 215/306 |
| 2008/0087624 | A1 | 4/2008 | Buckley | |
| 2009/0236341 | A1 | 9/2009 | McKinney et al. | |
| 2011/0278216 | A1 * | 11/2011 | Hull | A47G 19/2266 210/236 |

OTHER PUBLICATIONS

Camelbak, "Chute" Water Bottle, http://shop.camelbak.com/chute-insulated-61/d/1370_cl_5985, prior to 2016.

Camelback "Chute" Cap, http://shop.camelbak.com/chute-cap/d/1326_c1_5343, prior to 2016.

Miksovsky et al, Design U.S. Appl. No. 29/542,405, filed Oct. 14, 2015.

Miksovsky et al, Design U.S. Appl. No. 29/542,403, filed Oct. 14, 2015.

Miksovsky et al, Design U.S. Appl. No. 29/542,404, filed Oct. 14, 2015.

* cited by examiner

WATER BOTTLE CAP

RELATED APPLICATIONS

This application is a Continuation-in-Part of U.S. Design patent application Ser. Nos. 29/542,403, 29/542,404, and 29/542,405, all filed on Oct. 14, 2015, and which are hereby incorporated herein by reference for all purposes.

BACKGROUND OF THE INVENTION

The present invention relates generally to water bottles. More particularly, the invention relates to caps that may be used for a variety of portable reusable water bottles.

Water bottles are used by people all over the world to store beverages and to serve as a vessel for bringing beverages to their mouths. Sometimes, water bottles are designed to be reusable and therefore more environmentally friendly than disposable plastic water bottles. Such reusable water bottles typically have a bottle portion for holding a liquid and a cap for covering the opening of the bottle portion. Some water bottles have a cap that is separate from the water bottle and other water bottles have a cap that is connected to the water bottle by a strap. Some water bottles may have a spout on the cap that can be opened for drinking or for pouring liquid out of the bottle. However, these water bottles typically have a small spout, which makes it difficult to fill and clean the water bottle.

Other water bottles have a wide mouth and are therefore easy to fill and clean. However, the wide-mouth water bottles are typically difficult to drink from because the opening is too wide to drink from easily without spilling. Narrow-mouth water bottles are much easier to drink from, but filling such bottles, especially putting ice cubes in them, is much more difficult. Similarly, cleaning narrow-mouth bottles is quite difficult and may require specially designed bottle brushes.

Although these existing reusable water bottles work quite well, there are continuing efforts to develop new reusable water bottles and caps that provide improved function and convenience.

SUMMARY OF THE INVENTION

In accordance with an embodiment, a water bottle cap is provided. The water bottle cap includes a small cap portion, a large cap portion, and a flexible strap. The large cap portion has a spout with threads on an outer surface. The small cap portion has threads that correspond to the threads of the large cap portion such that the small cap portion can be screwed onto the spout. The large cap portion has a diameter larger than a diameter of the small cap portion. The flexible strap has a small ring on a first end and a large ring on a second end. The small ring has a tethering feature and the small ring is positioned in a groove around a base of the small cap portion and the small cap portion can rotate freely while the small ring remains stationary in the groove around the base of the small cap portion. The large ring is positioned in a groove around a base of the large cap portion and the large cap portion can rotate freely while the large ring remains stationary in the groove around the base of the large cap portion, and the tethering feature can be removably coupled to the strap.

In accordance with another embodiment, a water bottle cap system is provided. The water bottle cap system includes a large cap having a spout, a small cap configured to screw onto the spout, and a flexible strap coupling the small cap to the large cap. The flexible strap has a small ring on a first end and a large ring on a second end. The small ring is positioned around a base of the small cap and the large ring positioned around a base of the large cap. A tethering feature is on an end of the small ring opposite the first end of the strap, and the tethering feature is configured to engage a corresponding feature on the strap to removably couple the small ring to the strap.

In accordance with yet another embodiment, a method is provided for assembling a water bottle cap system. A large cap having a spout and a small cap that can be screwed onto the spout are provided. A flexible strap attached to a small ring on a first end and to a large ring on a second end is also provided. The small ring includes a tethering feature configured to engage a corresponding feature to tether the small ring and small cap to the strap. The small ring is positioned around a base of the small cap, and the large ring is positioned around a base of the large cap.

BRIEF DESCRIPTION OF THE DRAWINGS

The invention, together with further objects and advantages thereof, may best be understood by reference to the following description taken in conjunction with the accompanying drawings in which.

DETAILED DESCRIPTION OF THE PREFERRED EMBODIMENTS

Figure 1A:
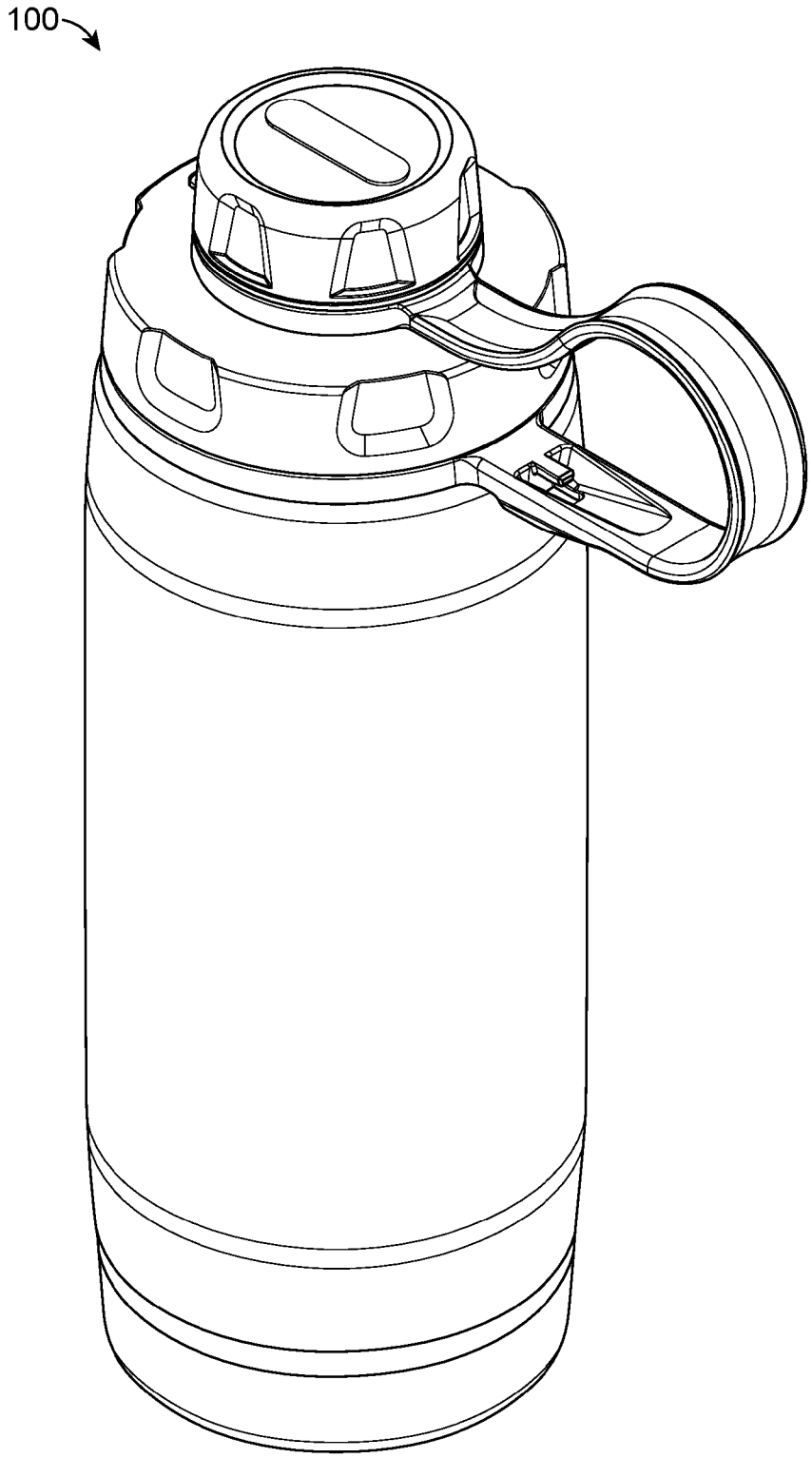
FIGS. 1A and 1B are perspective views of a water bottle cap attached to a water bottle in a closed position and in an open position, respectively, in accordance with an embodiment.
Figure 1B:
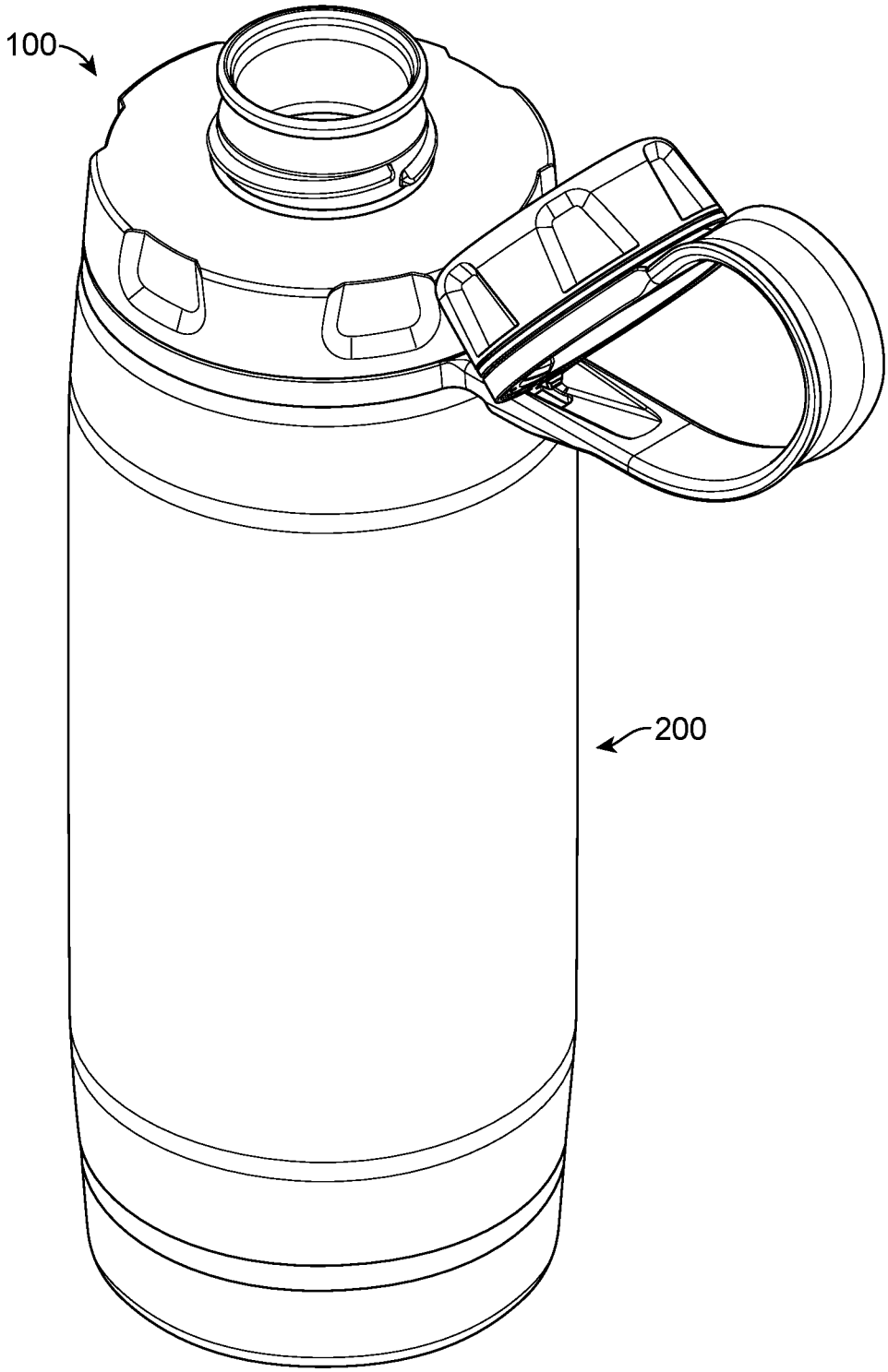
Figure 1C:
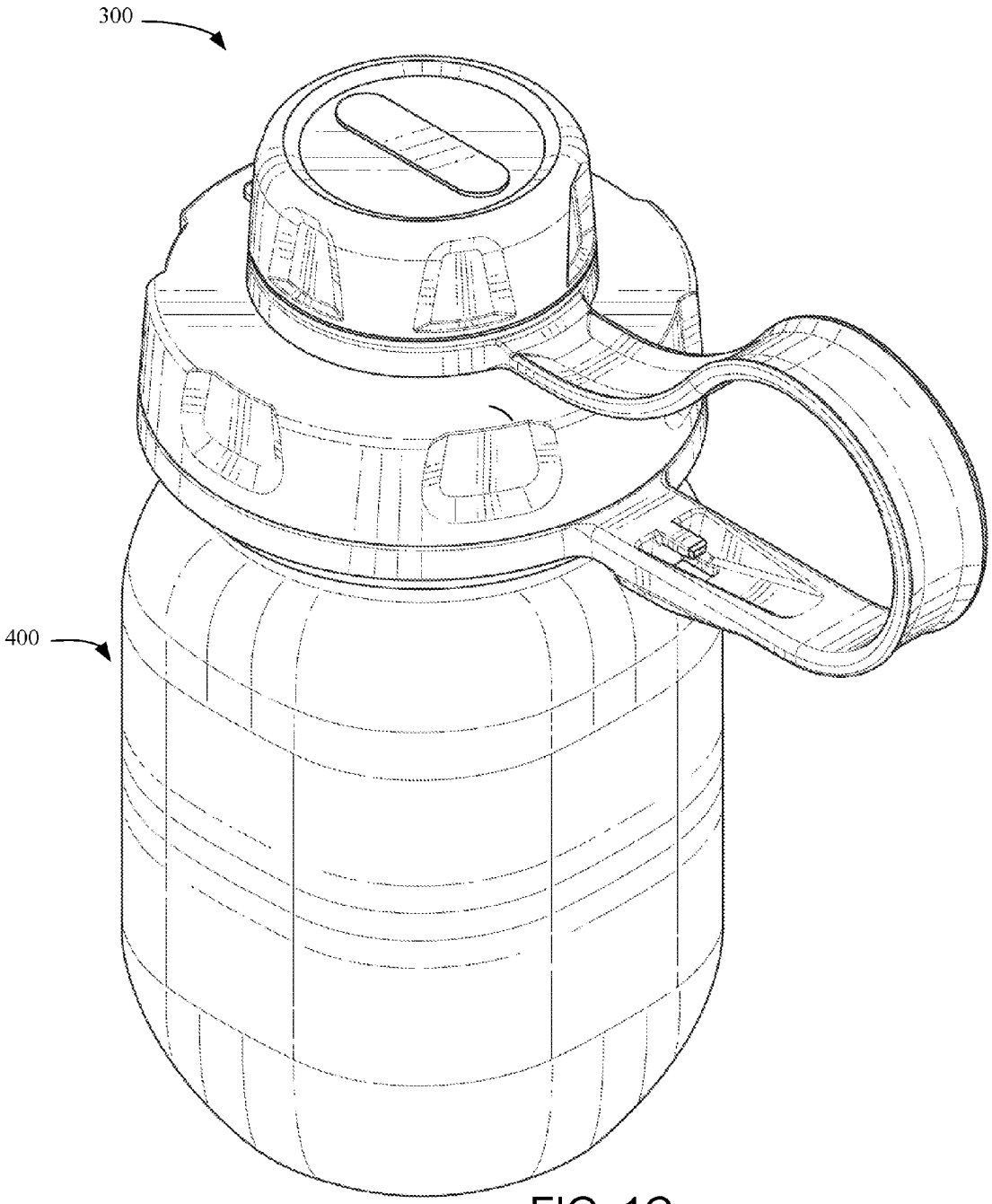
FIG. 1C is a perspective view of a water bottle cap attached to a mason jar in accordance with an embodiment.

The present invention relates generally to water bottle caps. Referring to FIGS. 1-7, a water bottle cap 100 in accordance with one embodiment of the invention will be described. In some embodiments, a water bottle cap system 100 can be designed to be used with a variety of water bottles 200, including the Nalgene®, CamelBak®, Hydro Flask®, Klean Kanteen®, and other popular wide mouthed drink bottles. In other embodiments, the water bottle cap system 100 can be designed to be used with other water vessels, such as a mason jar. As shown in FIGS. 1A-1B, the water bottle cap system 100 converts a wide-mouth water bottle 200 into a comfortable drinking bottle. FIG. 1C shows a water bottle cap system 300 that is configured to be used with a mason jar 400.

Figure 2:
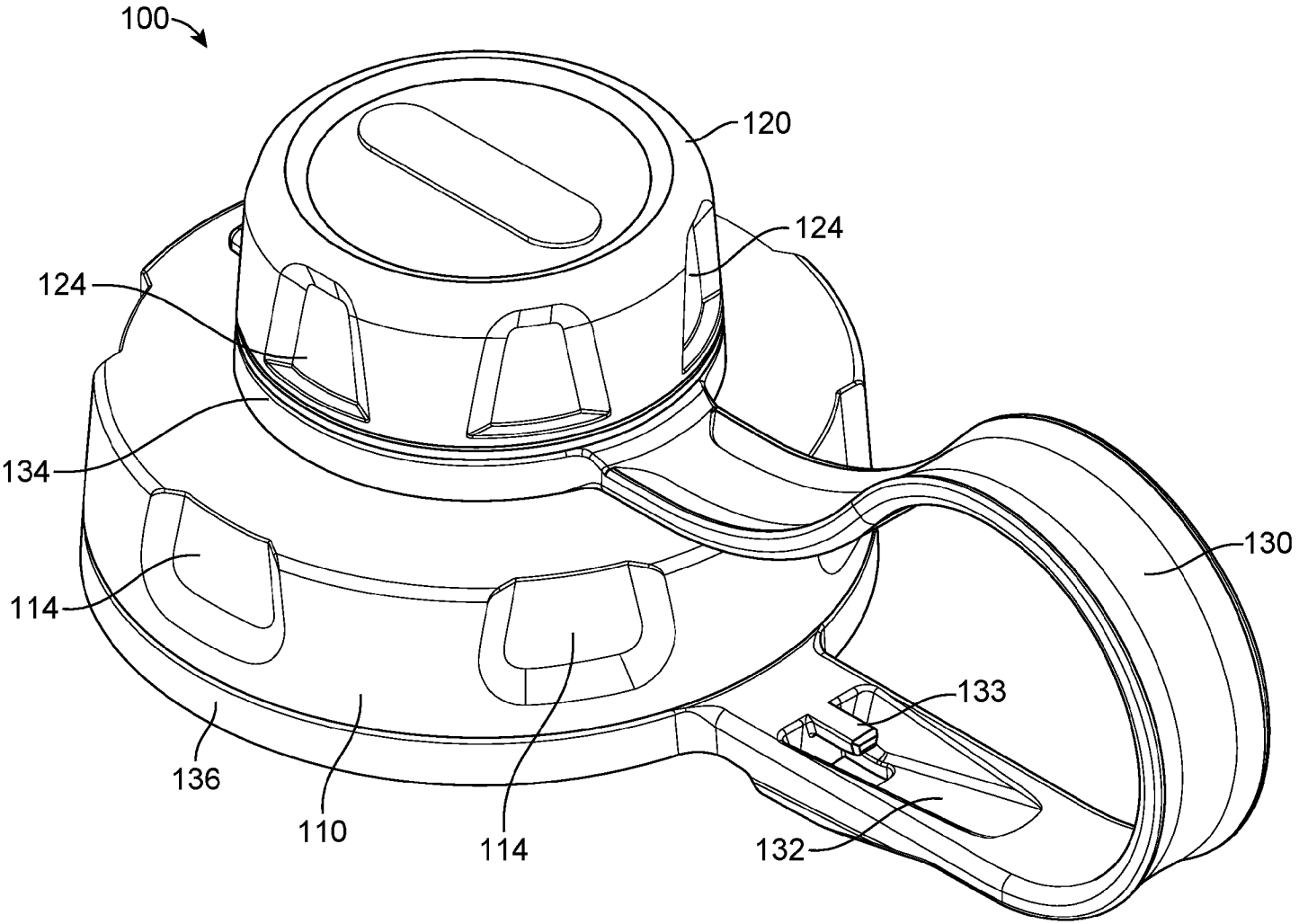
FIG. 2 is a perspective view of a water bottle cap in its closed position in accordance with an embodiment.
Figure 3:
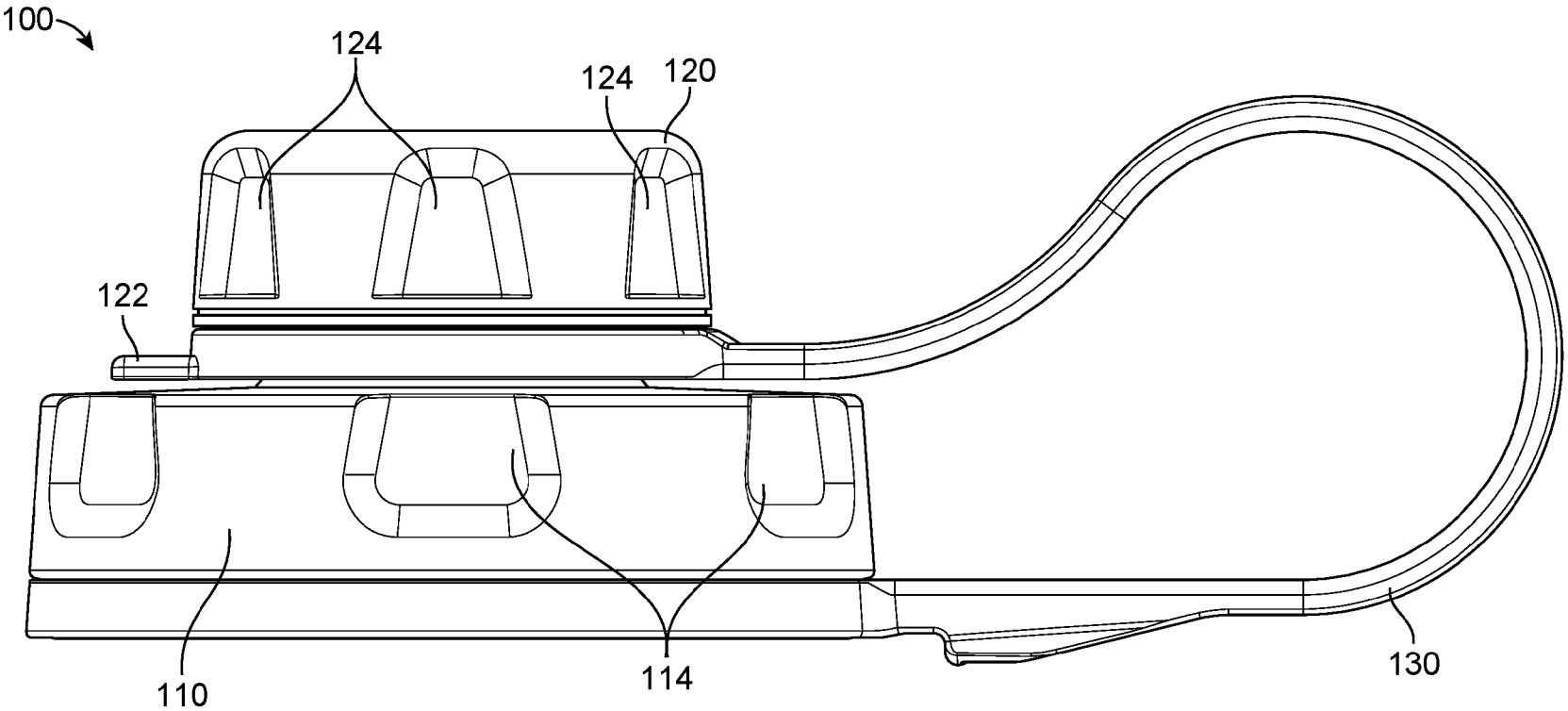
FIG. 3 is a side view of the embodiment shown in FIG. 2.
Figure 4:
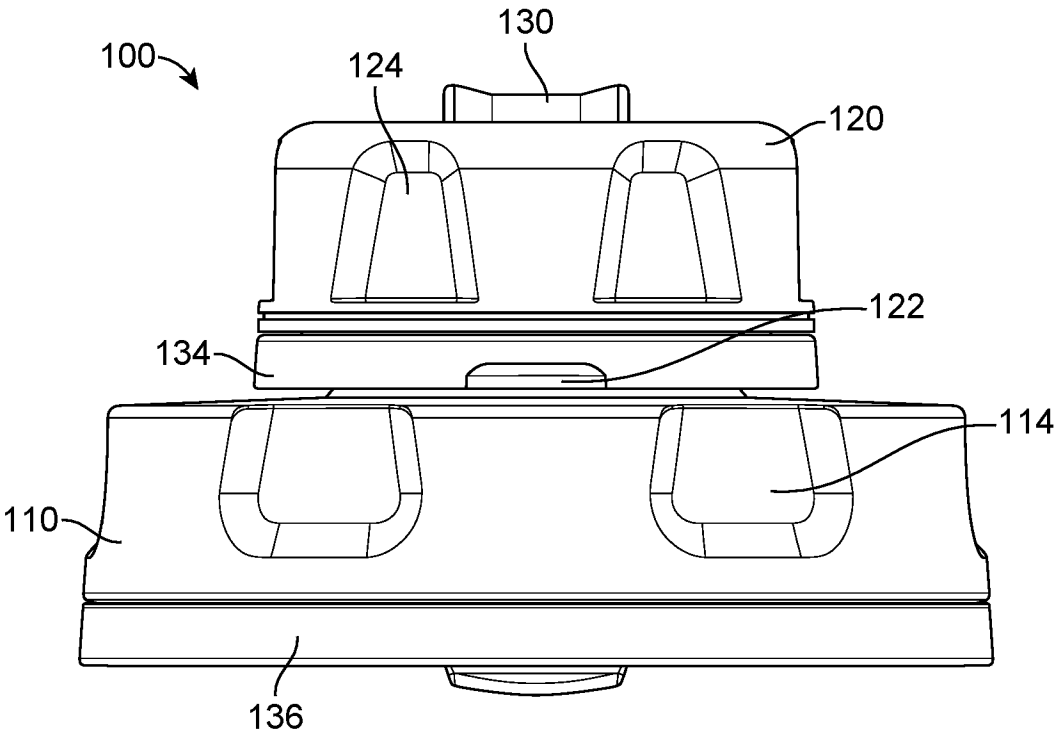
FIG. 4 is a front view of the embodiment shown in FIGS. 2 and 3.
Figure 5:
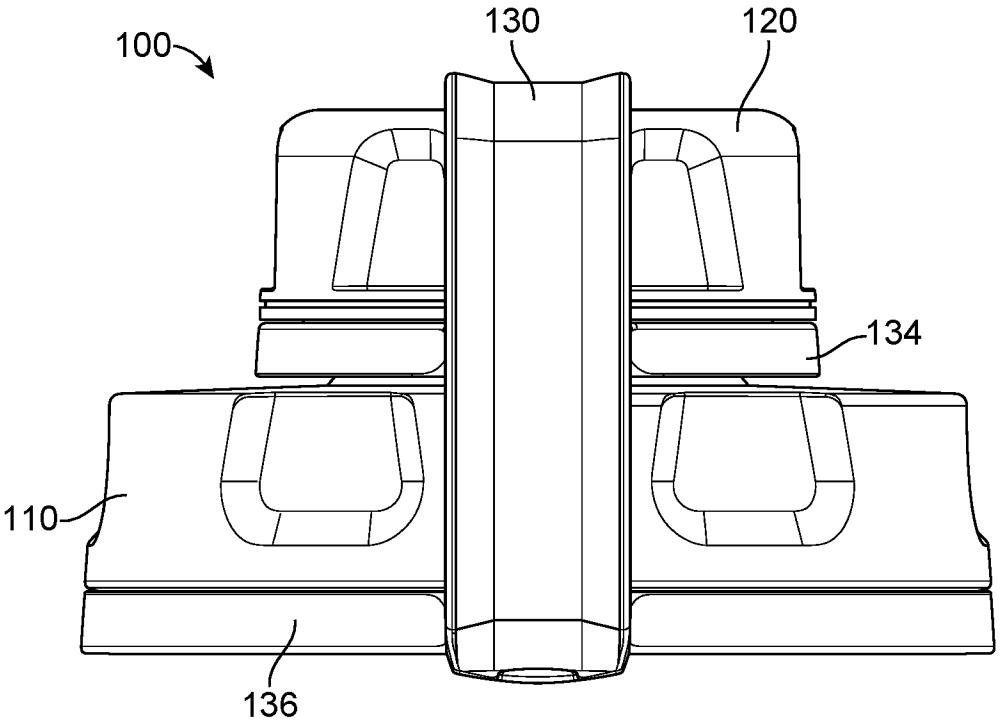
FIG. 5 is a back view of the embodiment shown in FIGS. 2-4.
Figure 6:
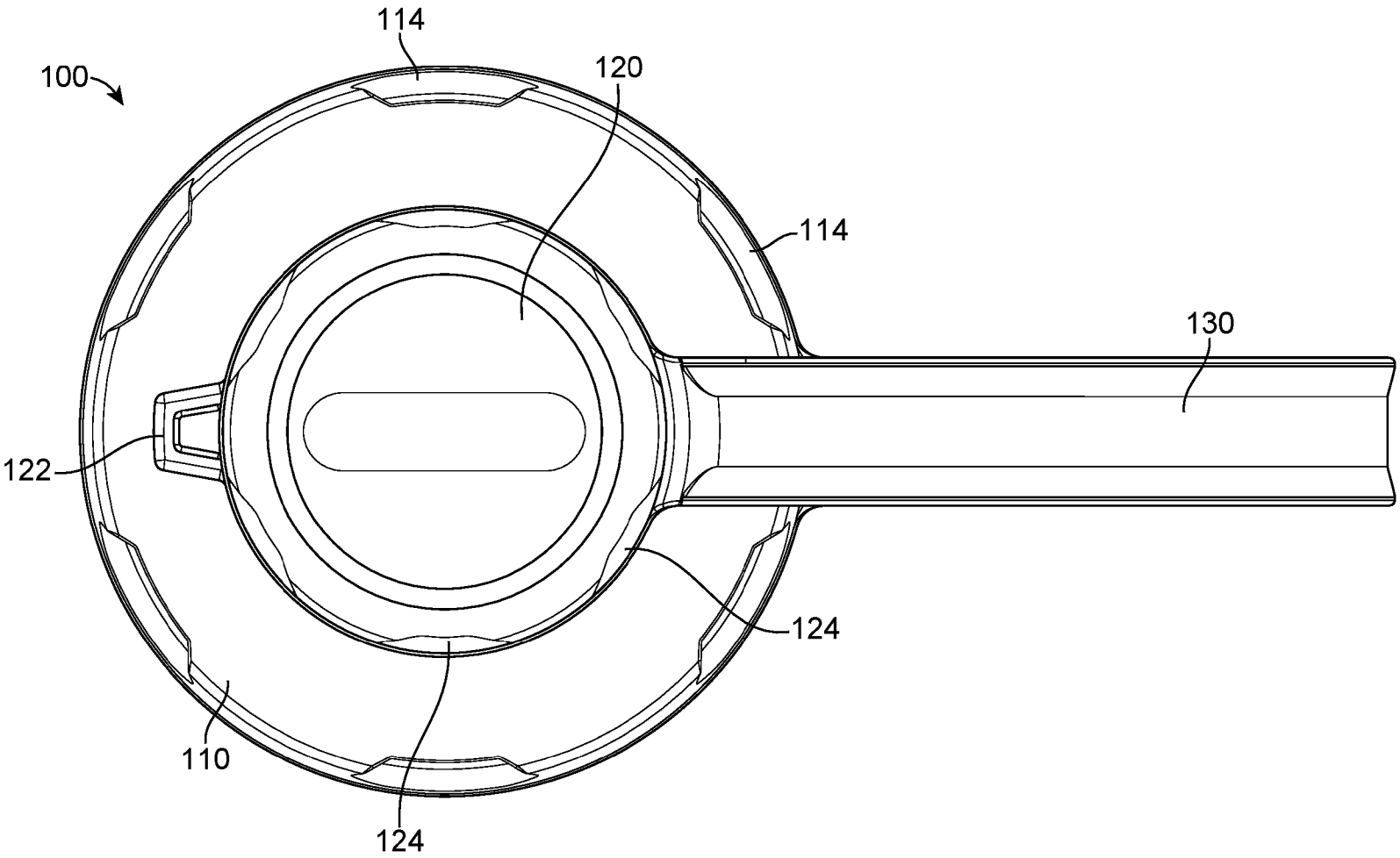
FIG. 6 is a top plan view of the embodiment shown in FIGS. 2-5.
Figure 7:
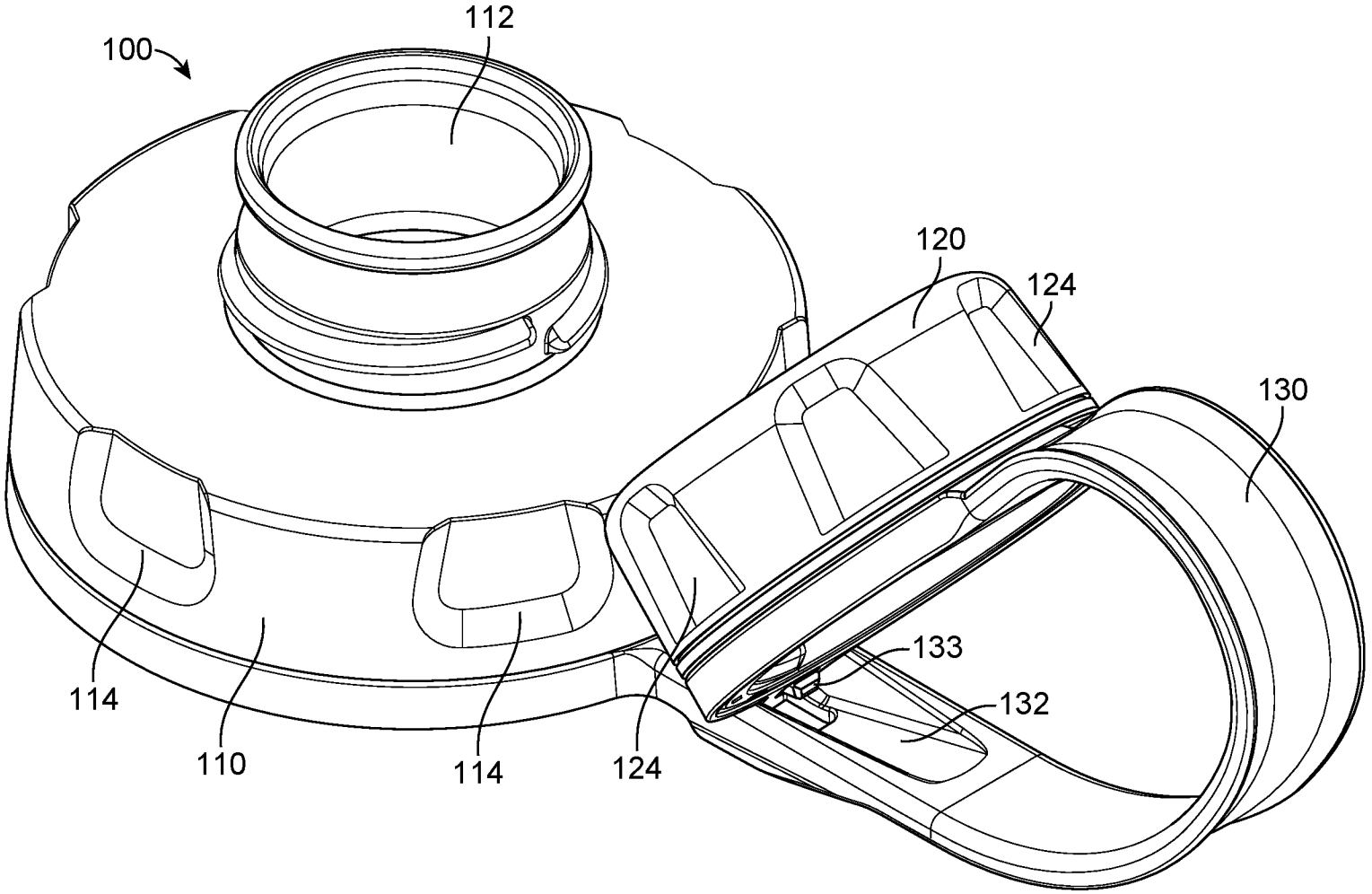
FIG. 7 is a perspective view of the embodiment shown in FIGS. 2-6 in an open position and with the small cap portion stored on the strap.

In the embodiments described herein, the water bottle cap system 100 includes a large cap portion 110 and a small cap portion 120 that are connected together by a flexible strap 130. FIG. 2 is a perspective view of the water bottle cap 100 system in its closed position with the small cap portion 120 screwed on the large cap portion 110, in accordance with an embodiment. FIG. 3 is a side view of the water bottle and FIGS. 4 and 5 are front and back views, respectively, of the water bottle cap system 100 in its closed position. FIG. 6 is a top view of the water bottle cap 100 in its closed position, and FIG. 7 is a perspective view of the water bottle cap 100 in its open position with the small cap portion 120 temporarily attached to the strap 130.

In the illustrated embodiments, the strap 130 is part of a strap assembly, which includes the strap 130, a small ring 134, and a large ring 136. The strap 130 is connected at one end to the small cap portion 120 via a small ring 134 and at the other end to the large cap portion 110 via a large ring 136. According to an embodiment, the strap 130 is formed integrally with the small ring 134 on one end and also formed integrally with the large ring 136 at the other end. The small ring 134 is positioned around the base of the small cap portion 120 and encircles the base such that the small cap portion 120 can turn freely relative to the small ring 134. According to an embodiment, the small ring 134 is positioned in a groove around the base of the small cap portion 120.

Similarly, the large ring 136 is positioned around the base of the large cap portion 110 and encircles the base such that the large cap portion 110 can turn freely relative to the large ring 136. According to an embodiment, the large ring 136 is positioned in a groove around the base of the large cap portion 110. Thus, the strap 130 can remain stationary when the small cap portion 120 or the large cap portion 110 is turned for tightening or loosening. As described in more detail below, each of the small cap portion 120 and the large cap portion 110 has a threaded portion on an inner side surface near its base for engaging a corresponding threaded portion on the large cap portion 110 and a water bottle 200, respectively, to tighten or unscrew the small cap portion 120 and the large cap portion 110.

The strap 130, via the small ring 134 and large ring 136, couples the large cap portion 110 and the small cap portion 120 together for storage and transport, and also ensures that the small cap portion 120 remains coupled with the water bottle cap system 100 and water bottle. The strap 130 thus prevents the small cap portion 120 from being misplaced. The strap 130 also allows the small cap portion 120 to simply remain coupled with the large cap portion 110 and the water bottle even when a user is drinking from the bottle or when liquid is being poured from the bottle, as shown in FIG. 7. The strap 130 therefore minimizes the risk of contamination, as the small cap portion 120 does not need to be set down on a surface (e.g., table, ground, etc.) that may be contaminated.

As shown in FIG. 7, the small cap portion 120 can be unscrewed and removed from the large cap portion 110 to provide a small spout 112 for drinking as well as for pouring liquid from the water bottle 200. The small spout 112 is easier to pour liquid from than the wide mouth of the water bottle 200. Similarly, it is easier for a user to drink from the small spout than from the wide mouth of the water bottle 200 because the user may cover more of the small spout with his or her mouth and thereby prevent accidental spillage. The small spout protrudes upwards and thereby creates room for the user's nose when drinking, whereas the nose can hit the far side of the opening when drinking from a wide opening. The large cap portion 110 can be unscrewed and removed from the water bottle 200 to reveal the wide mouth of the water bottle 200 for easy filling and cleaning.

The large cap portion 110 can be screwed onto the wide mouth of the water bottle to cover the mouth of the water bottle 200 via a threaded portion on the interior side wall of the large cap portion 110 that engages threads on the rim portion of the mouth of the water bottle 200. The small cap portion 120 can similarly be provided with threads on its interior side wall so that the small cap portion 120 can be screwed onto or removed from the threaded portion of the opening or spout 112 of the large cap portion 110. As shown in FIGS. 1B and 7, the small cap portion 120 can be unscrewed from the large cap portion 110 to reveal the opening or spout 112 of the large cap portion 110. As shown in FIG. 6, in the closed position, the small cap portion 120 and the large cap portion 110 are concentric when viewed from the top. Thus, the large cap portion 110, with its spout 112, converts a wide mouth water bottle into a water bottle from which it is convenient to drink and/or pour. The small cap portion 120 is provided as a cap for the converted water bottle.

The strap 130 also allows the user to hold or carry the water bottle without having to grasp the bottle portion itself when transporting the water bottle. When the small cap portion 120 is in the closed position (screwed onto the threaded portion of the spout 112 of the large cap portion 110, which, in turn, is screwed onto the threaded rim of the water bottle), a user can simply hold onto the strap 130 in order to transport the water bottle. For example, a user's finger can be hooked through the loop of the strap 130 when the small cap portion 120 is screwed onto the threaded portion of the spout 112 to support the entire water bottle 200 and cap system 100. According to an embodiment, the strap 130 has rounded or curved edges that are more comfortable for a user's hand. Allowing the user to hold the water bottle by the strap 130 may provide the user a more comfortable and/or convenient way to hold the water bottle.

The small cap portion 120 can be temporarily attached or tethered to the strap 130 when the small cap portion 120 is unscrewed from the large cap portion 110 in order to hold the small cap portion 120 out of the way of the spout 112 while a user is drinking from the bottle or while a user is pouring liquid from the bottle. The small cap portion 120 can be tethered to the strap 130 in different ways. Different embodiments for tethering are described below.

In an embodiment, the strap 130 includes a channel 132 with a tab 133. The tab 133 is provided to hook a loop 122 (FIG. 6) on the small ring 134 in order to temporarily secure the small cap portion 120 to the strap 130 in a "stored" position to keep the small cap portion 120 out of the way of the spout 112, as shown in FIG. 7. The loop 122 protrudes from an end of the small ring 134 opposite the strap 130. With the small cap portion 120 attached to the channel 132 of the strap 130 in the "stored" position, the small cap portion 120 is out of the way of the spout 112 of the large cap portion 110 when a user is drinking from the water bottle and when a user is pouring liquid from the water bottle.

The channel 132 is sized and shaped to receive the loop 122 of the small ring 134, and the tab 133 can engage the loop 122 to secure the loop 122 to the tab 133. As shown in the illustrated embodiment, the channel 132 is recessed and the tab 133 does not protrude above the top surface of the strap 130, so that the user's fingers will not catch on the tab 133, which could lead to discomfort for the user.

According to this embodiment, the tethering can be released simply by pulling up on the strap 130 (when the small cap portion 120 is tethered). The pulling up action causes the loop 122 to slide up and along the tab 133 until it slides completely off of the tab 133. This quick, automatic release feature prevents a user from carrying the bottle by the strap 130 in the tethered mode, which places undue strain on the tethering mechanism. According to this embodiment, the tethering releases as soon as a user pulls upward on the strap 130, which is not only very easy and convenient to do, but also eliminates the chance that the bottle can be carried from the tethered strap so the tether features (e.g., tab 133, loop 122) are much less likely to bend or break under those carrying loads.

As noted above, the strap 130 is flexible. The flexible nature of the strap 130 allows the small cap portion 120 to be screwed onto the spout 112 of the large cap portion 110 (as shown in FIGS. 2-5) or in a "stored" position temporarily attached to the channel 132 of the strap 130 (as shown in FIG. 7). Suitable materials for the strap 130 include polyethylene, polypropylene, and other flexible plastic materials.

Figure 8A:
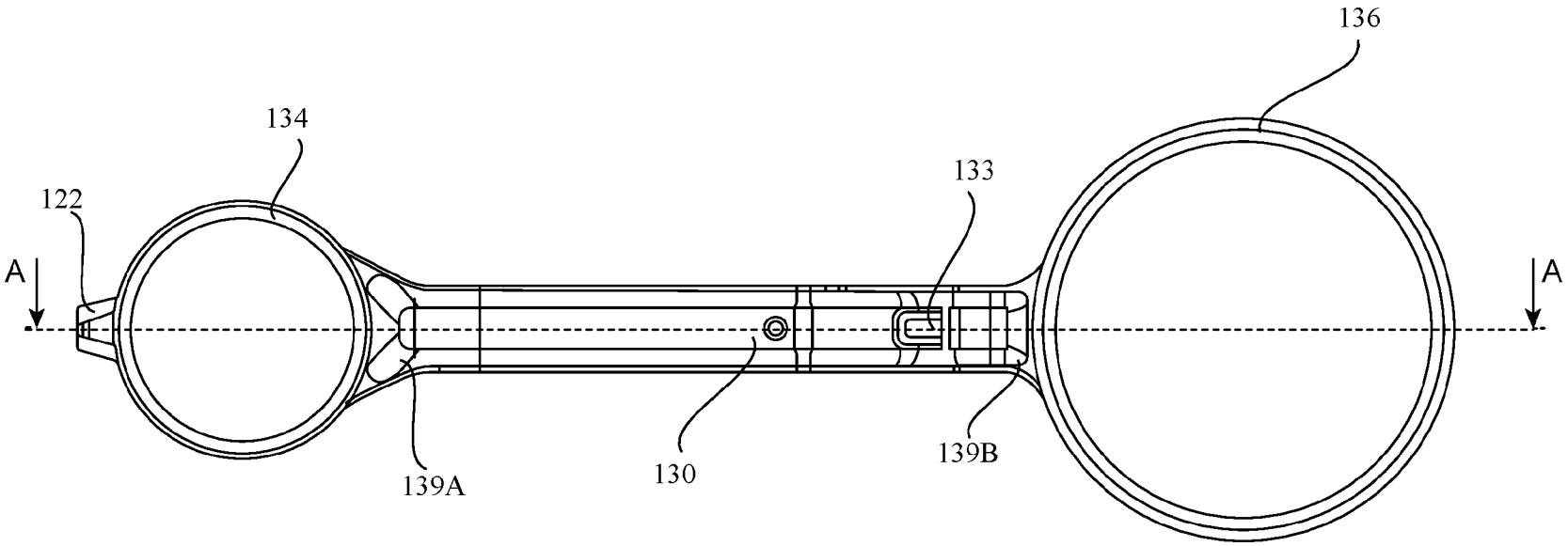
FIGS. 8A-8C show different views of the strap assembly in accordance with an embodiment.
Figure 8B:
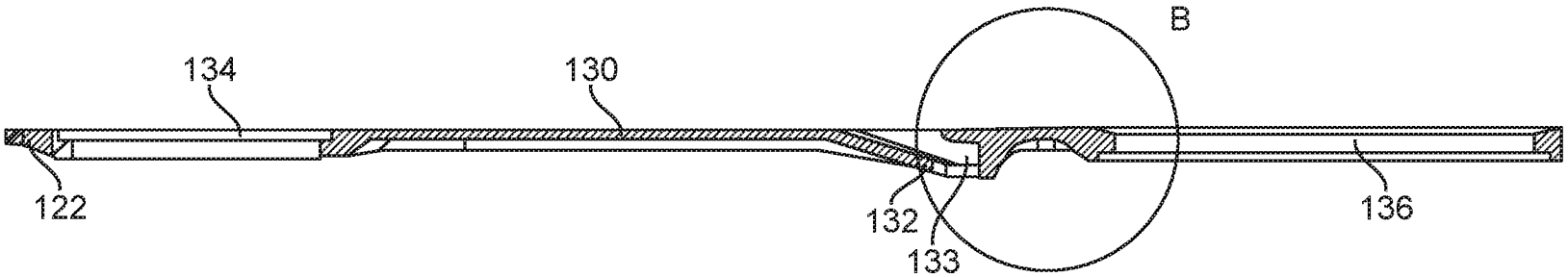
Figure 8C:
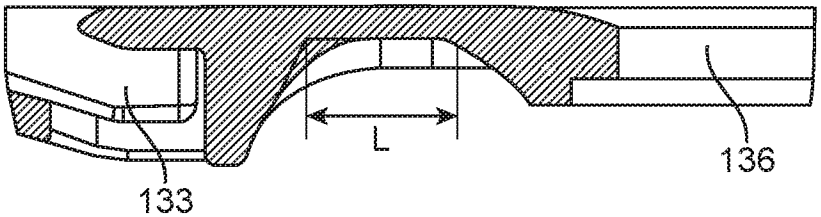
Figure 9:
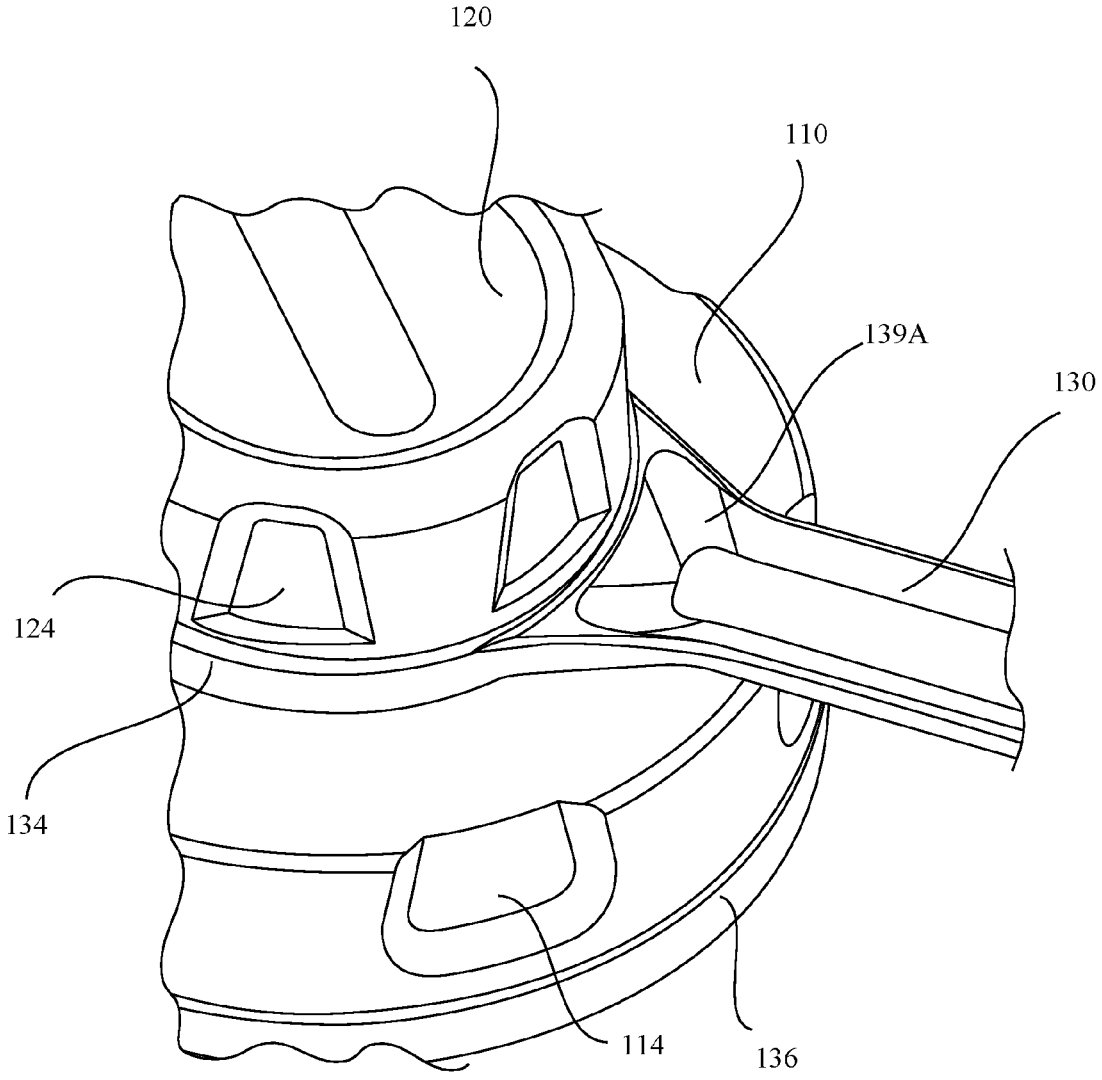
FIG. 9 is a view of the embodiment of the strap shown in FIGS. 8A-8C where the strap transitions to the small ring.

FIGS. 8A-8C and 9 show different views of the strap 130, small ring 134, and large ring 136 in accordance with an embodiment. FIG. 8A is a top view of the strap assembly. FIG. 8B is a side cross-sectional view of the strap assembly and FIG. 8C is a detailed view of the area in circle B of FIG. 8B. In this embodiment, the strap 130 has a transition zone 139A that flares slightly as it transitions to the small ring 134 on one end and also another transition zone 139B that flares slightly as it transitions to the large ring 136 on the other end. These flared transition zones 139A, 139B can be seen in FIGS. 8A and 9. According to an embodiment, the flared transition is preferably at an angle in a range of about 15°-35°, more preferably at an angle in a range of about 20°-30°, and even more preferably at an angle of about 27°.

In this embodiment, the flared transition zone 139A of the strap 130 is stiffer than the rest of the strap 130 and minimizes bending of the strap 130 close to the small cap portion 120 (in the area of the flared transition). This stiffer transition zone 139A prevents binding on the cap itself. The flare forces the strap 130 to bend just where the flare transitions to the mid-section of the strap (the long straight section). Without the flare, if a user holds the strap/cap/bottle by the strap loop, a force is applied to the small ring 134. This bending force can cause the small ring 134 to deform so that when a user unscrews the small cap portion 120, there is excess friction between the small cap portion 120 and the small ring 134. With this extra friction, the small cap portion 120 "grabs" the small ring 134 and twists the strap 130, rather than rotating freely. The flared transition zone 139A causes the bending force to be just on the strap 130 itself, and not on the small ring 134. This reduces the chance of deformation on the small ring 134, and the attendant friction.

As shown in FIG. 8C, in the transition zone 139B between the large ring 136 and the midsection of the strap 130, there is a substantially flat section between the channel 132 and the large ring 136. The length L of this substantially flat section is preferably in a range of about 1.8 mm-11.8 mm, more preferably in a range of about 3 mm-8 mm, and even more preferably about 6.8 mm. As shown in FIG. 8C, the substantially flat section is thinner than the large ring 136.

As will be described below with reference to FIGS. 10-13, alternative tethering options can be provided by providing the strap and small ring with different features for use with a water bottle 200 and small cap portion 120 and large cap portion 110.

Figure 10A:
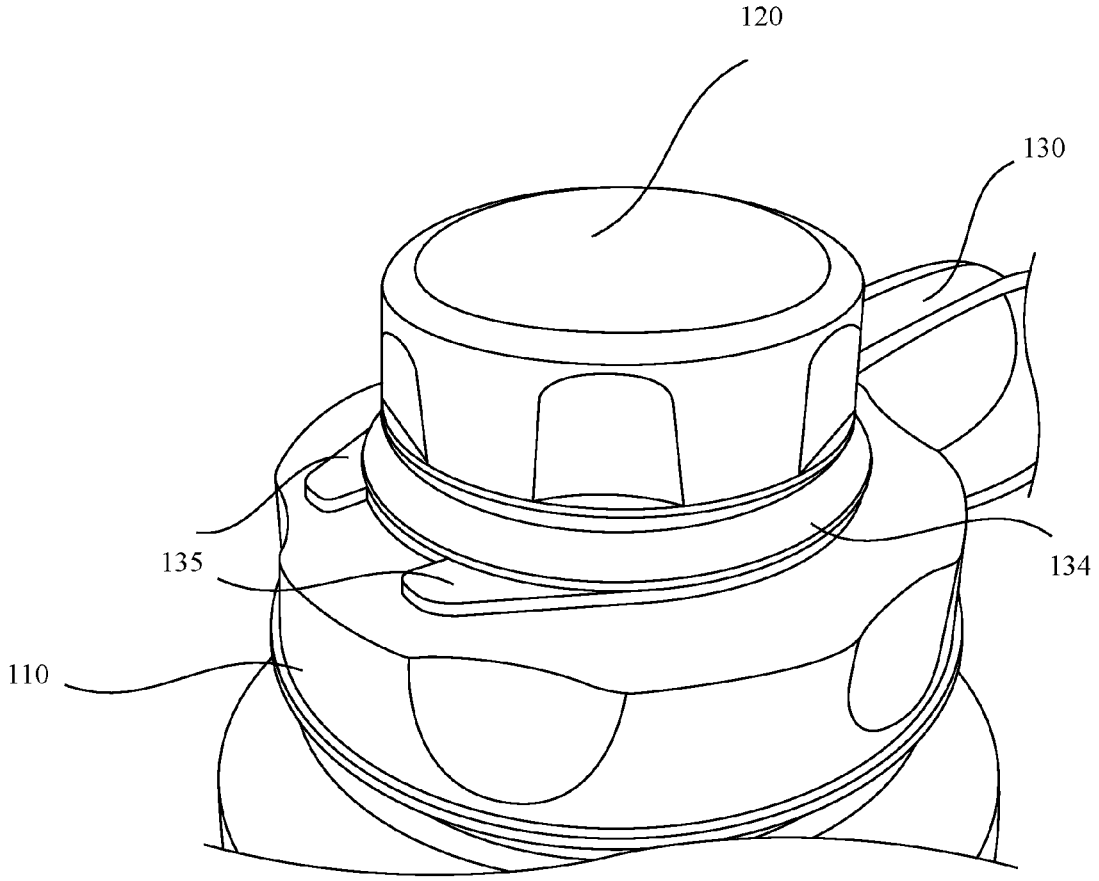
FIGS. 10A-10C show an embodiment of the strap assembly for tethering the small cap portion to the strap.
Figure 10B:
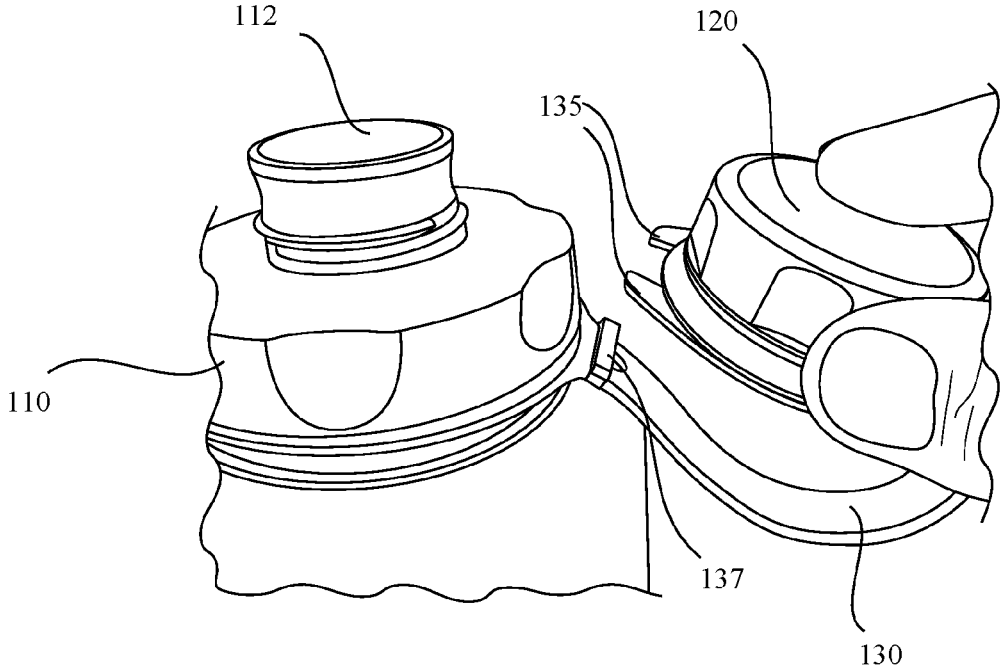
Figure 10C:
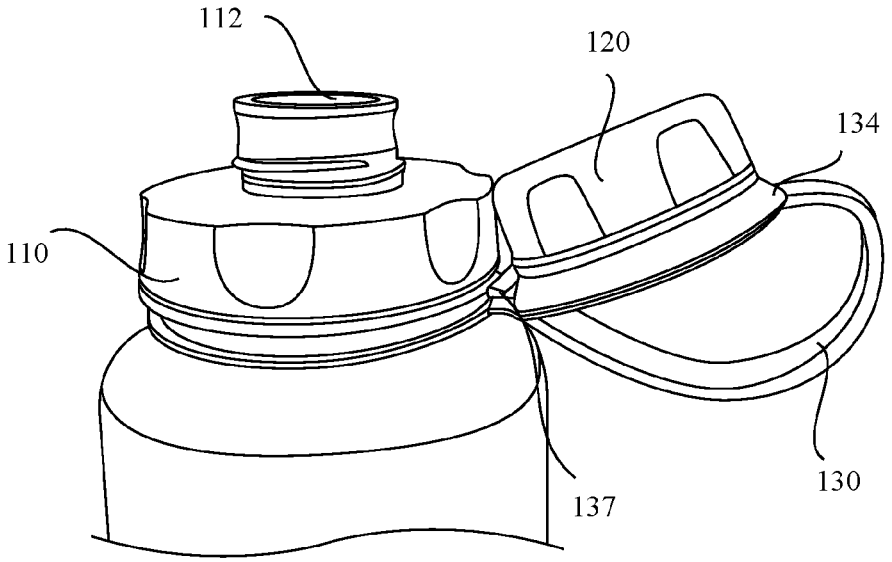

In the embodiment shown in FIGS. 10A-10C, the small ring 134 is provided with a pair of horns 135 protruding from the end of the small ring 134 opposite the strap 130. The horns 135 can be formed either integrally with the small ring 134 or, as shown in the illustrated embodiment, as a separate piece attached to the small ring 134. According to this embodiment, the flexible strap 130 is provided with a band 137 around the strap 130, as shown in FIGS. 10B and 10C. The space between the band 137 and the strap 130 serves as a slot into which the horns 135 can be inserted to tether the small cap portion 120 to the strap 130. The horns 135 can be disengaged from the band 137 by simply pulling the small cap portion 120 away from the large cap portion 110 and pulling the horns 135 out from the space between the band 137 and the strap 130.

Figure 11A:
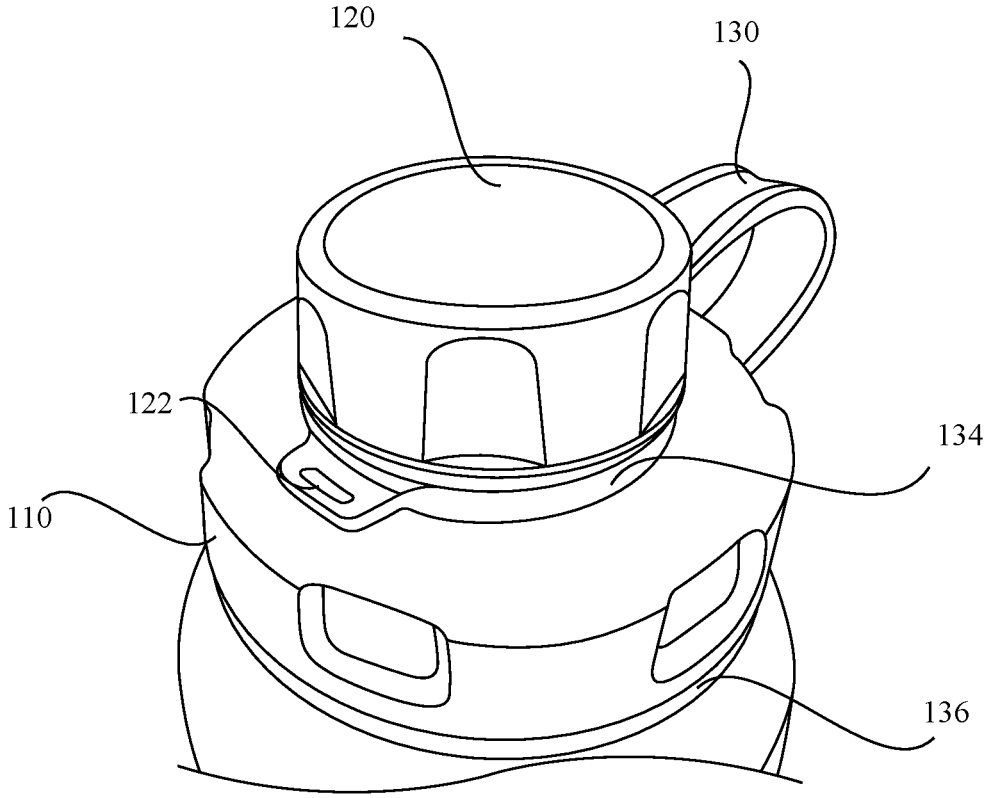
FIGS. 11A-11C show an alternative embodiment of the strap assembly for tethering the small cap portion to the strap.
Figure 11B:
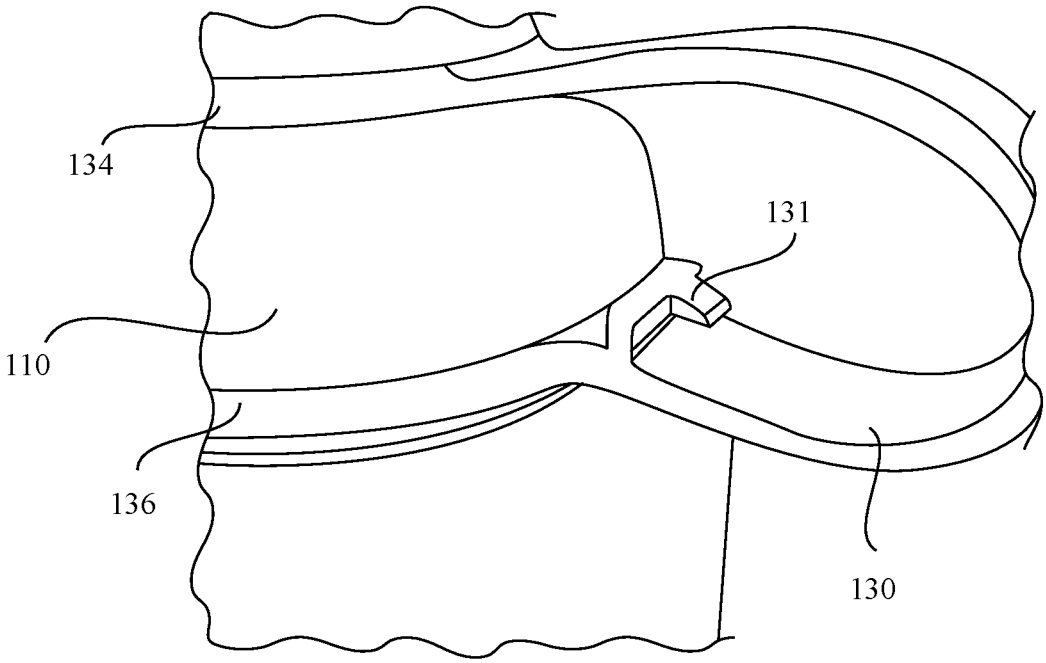
Figure 11C:
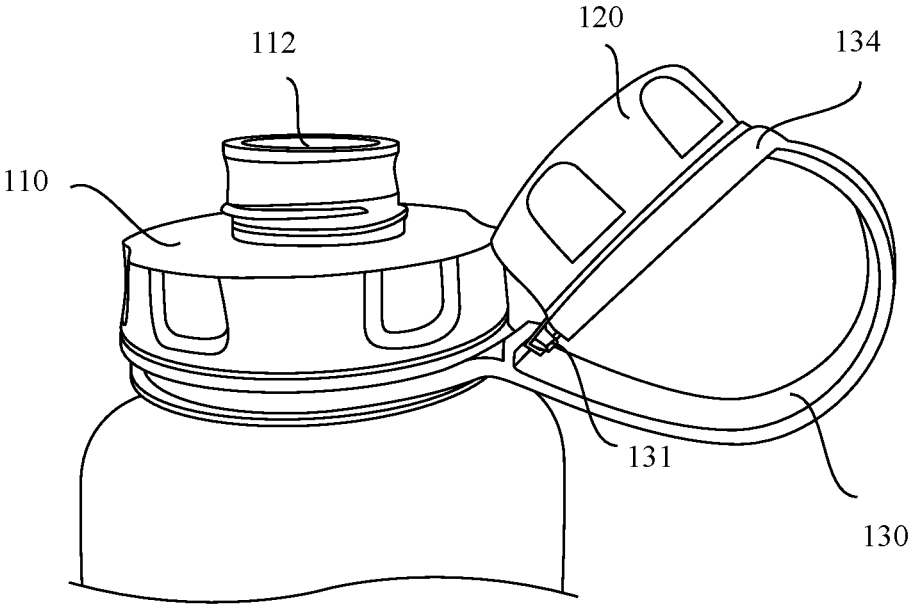

In the embodiment shown in FIGS. 11A-11C, the small ring 134 has a loop 122 on the end of the small ring 134 opposite the strap 130. As illustrated in FIG. 11B, a tab 131 is provided on the strap 130 where the strap 130 meets the small ring 134. As shown in FIG. 11C, the loop 122 can hook onto the tab 131 to tether the small cap portion 120 to the strap 130. As noted above, the tethering allows the small cap portion 120 to be temporarily attached to the strap 130 so that the small cap portion 120 is out of the way during drinking or pouring, but remains with the rest of the cap system 100. The loop 122 can be disengaged from the tab 131 by simply pulling the small cap portion 120 in a direction away from the large cap portion 110.

Figure 12A:
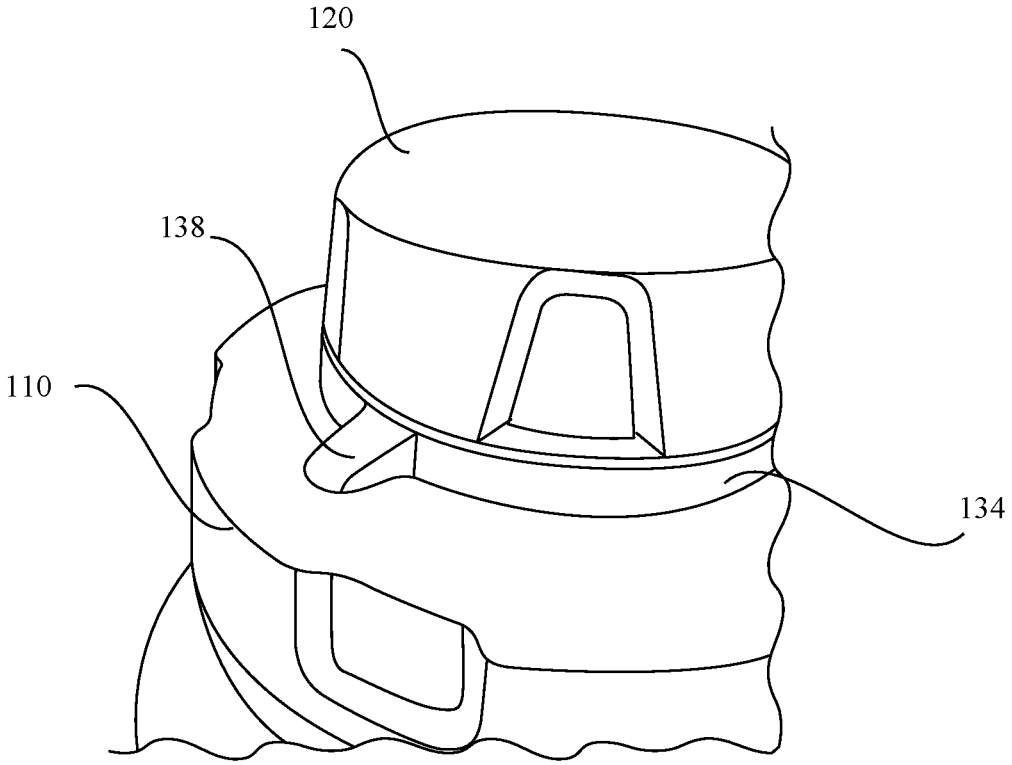
FIGS. 12A-12C show another embodiment of the strap assembly for tethering the small cap portion to the strap.
Figure 12B:
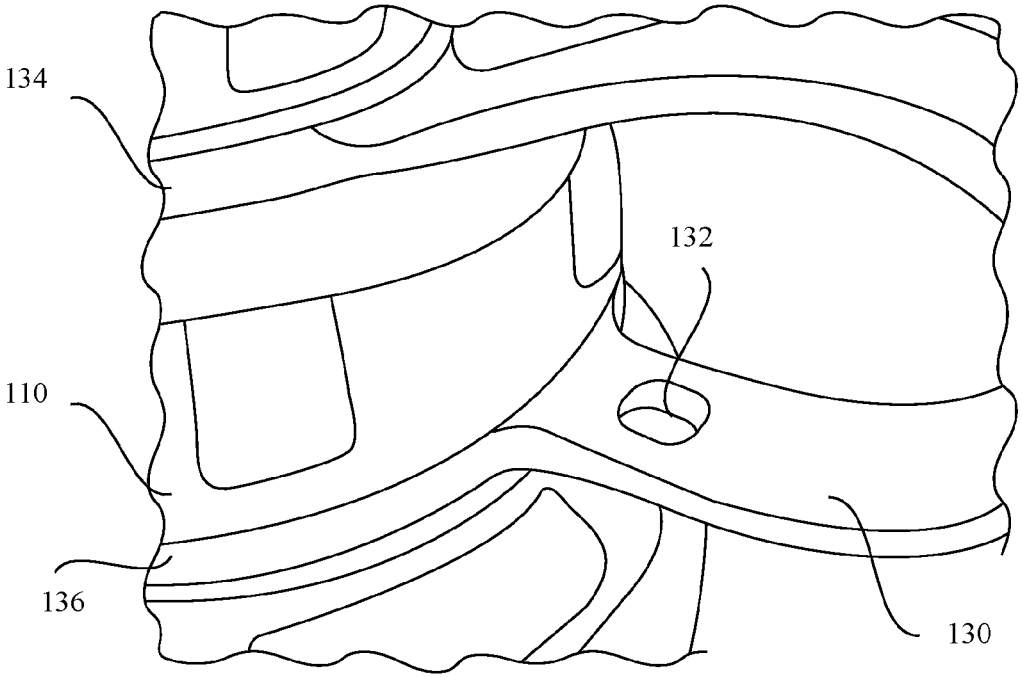
Figure 12C:
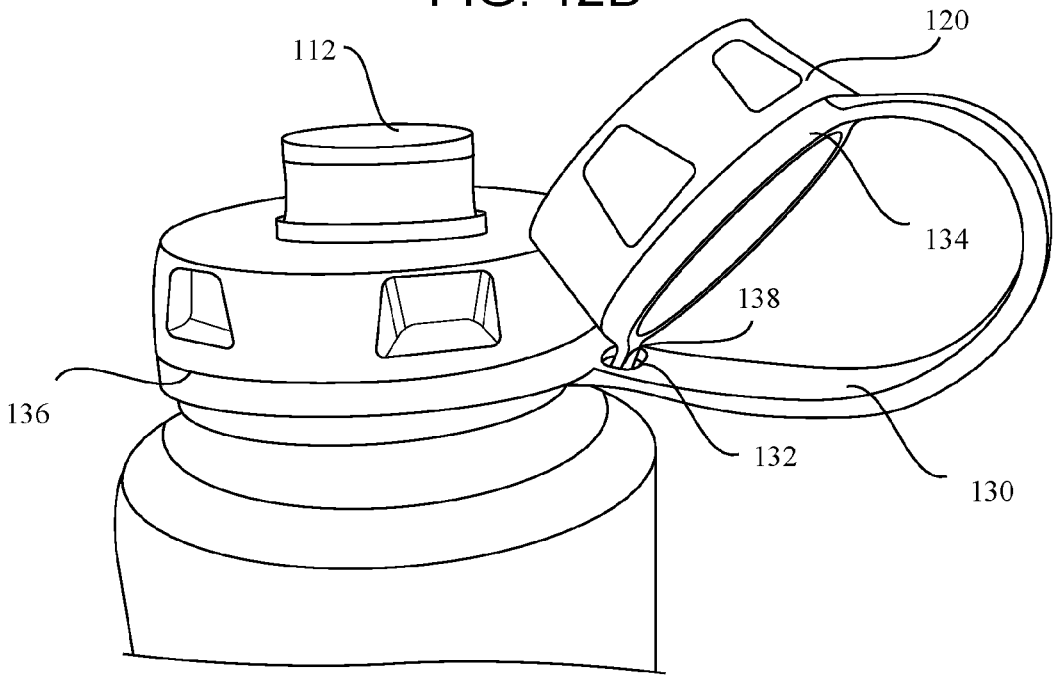

According to another embodiment, the small ring 134 has a protrusion 138 and the strap 130 includes a hole 132, as shown in FIGS. 12A-12C. As shown in FIG. 11A, the protrusion 138 is on the end of the small ring 134 opposite the strap 130. The hole 132 can receive and secure the protrusion 138 on the small ring 134, as shown in FIG. 12C, to hold the small cap portion 120 out of the way of the spout 112 of the large cap portion 110 when the small cap portion 120 is removed from the large cap portion 110. With the small cap portion 120 tethered to the strap 130, the small cap portion 120 not only remains attached to the rest of the water bottle cap 100 but also will not flap around nor hit the user in his or her face when drinking from the water bottle. The protrusion 138 can be disengaged from the hole 132 by simply pulling the small cap portion 120 away from the hole 132 of the strap 130.

Figure 13A:
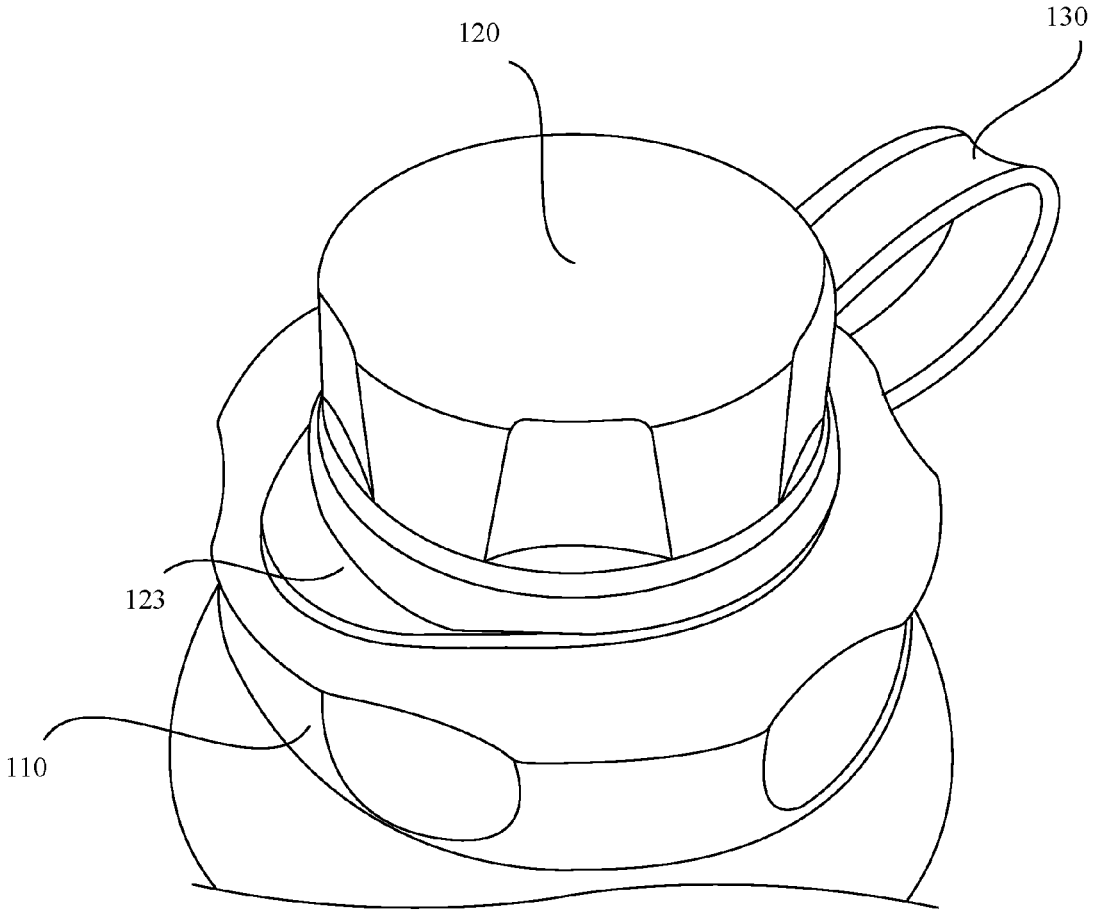
FIGS. 13A-13C show yet another embodiment of the strap assembly for tethering the small cap portion to the strap.
Figure 13B:
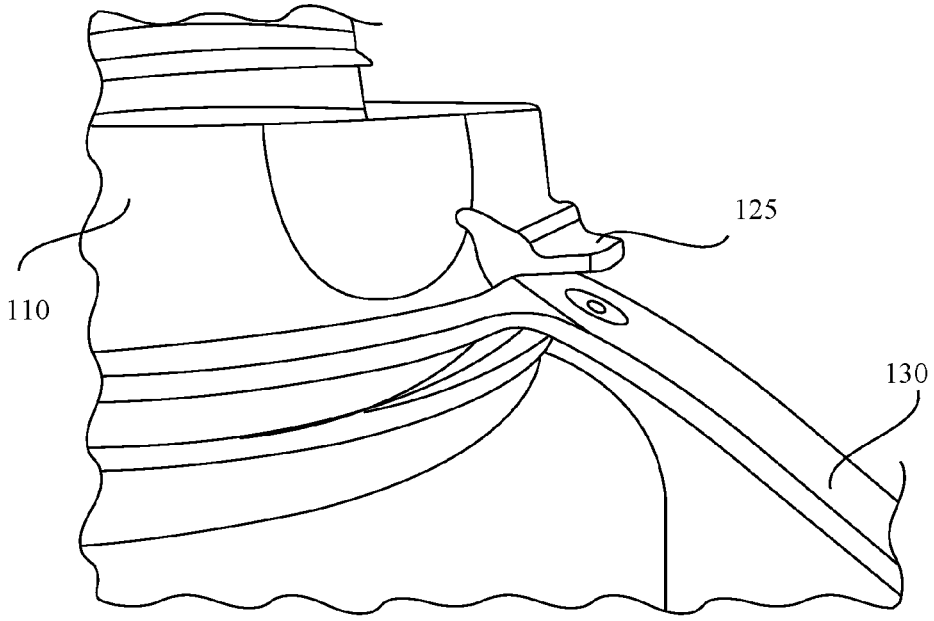
Figure 13C:
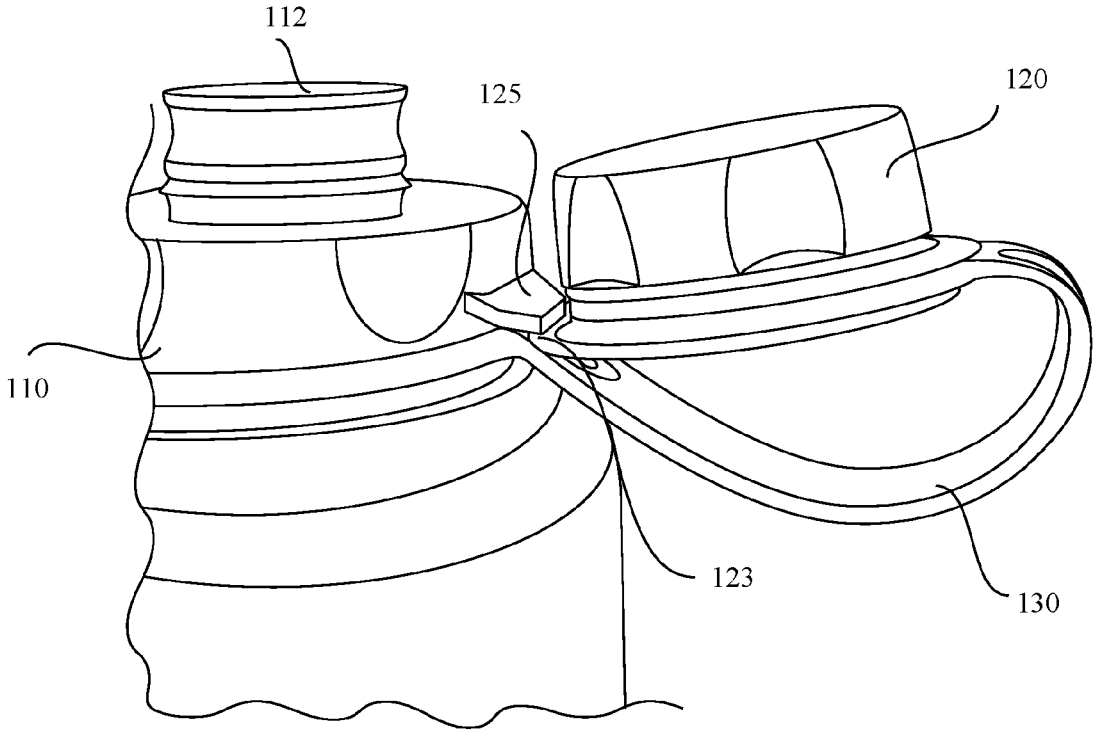

FIGS. 13A-13C show yet another embodiment having different features for tethering the small cap portion 120 to the strap 130. As shown in FIG. 13A, a protrusion 123 is on the end of the small ring 134 opposite the strap 130. In the illustrated embodiment, the protrusion 123 is formed of a separate plastic piece attached to the bottom of the small cap portion, as shown in FIG. 13A. However, in other embodiments, the protrusion 123 can be formed integrally with the small ring 134. As shown in FIG. 13B, a tab 125 is provided on the small cap portion 120 and protrudes from the small cap portion 120 just above the area where the strap 130 meets the small ring 134. As shown in FIG. 13C, the protrusion 138 can be inserted between the tab 125 and the strap 130 in order to tether the small cap portion 120 to the strap 130. The protrusion 123 can be disengaged from the tab 125 by simply pulling the small cap portion 120 in a direction away from the tab 125.

In an embodiment, the small cap portion 120 is provided with indentations 124 around its side surface. The indentations 124 allow the small cap portion 120 to be easily gripped by a user's fingers and twisted, to loosen or tighten the small cap portion 120 on the spout 112. Similarly, the large cap portion 110 can also be provided with indentations 114 so that the large cap portion can be easily gripped and twisted to tighten or loosen the large cap portion 110 from the mouth of the water bottle. As noted above, the small cap portion 120 can be turned freely while the small ring 134 remains stationary around the outside of the spout 112. Similarly, the large cap portion 110 can be turned freely while the large ring 136 remains stationary around the outside of the mouth of the water bottle.

According to an embodiment, the small cap portion 120 and the large cap portion 110 can be formed of a rubberized plastic material. The entire water bottle cap is preferably formed of BPA-free, Polycarbonate-free, and phthalate-free materials. Both caps are preferably made with FDA-approved, food-safe polypropylene plastic.

Although only a few embodiments of the invention have been described in detail, it should be appreciated that the invention may be implemented in many other forms without departing from the scope of the invention. In view of all of the foregoing, it should be apparent that the present embodiments are illustrative and not restrictive and the invention is not limited to the details given herein, but may be modified within the scope and equivalents of the appended claims.

What is claimed is:

1. A water bottle cap, comprising:

a small cap portion;

a large cap portion having a spout with threads on an outer surface, wherein the small cap portion has threads that correspond to the threads of the large cap portion such that the small cap portion can be screwed onto the spout, and wherein the large cap portion has a diameter larger than a diameter of the small cap portion; and a flexible strap having a small ring on a first end and a large ring on a second end, wherein the small ring has a tethering feature and the small ring is positioned in a groove around a base of the small cap portion and the small cap portion can rotate freely while the small ring remains stationary in the groove around the base of the small cap portion, wherein the large ring is positioned in a groove around a base of the large cap portion and the large cap portion can rotate freely while the large ring remains stationary in the groove around the base of the large cap portion, and wherein the tethering feature can be removably coupled to the strap, wherein the tethering feature protrudes from an end of the small ring opposite the flexible strap.

2. The water bottle cap as recited in claim 1, wherein the tethering feature is a protrusion.

3. The water bottle cap as recited in claim 2, wherein the strap has an opening configured to receive the protrusion to removably couple the tethering feature to the strap.

4. The water bottle cap as recited in claim 2, wherein the protrusion is substantially flat and the small cap portion has a tab adjacent the strap, the protrusion being sized and shaped for insertion between the tab and the strap.

5. The water bottle cap as recited in claim 1, further comprising a band around the strap, wherein the tethering feature comprises two protrusions that can be inserted between the band and the strap to couple the tethering feature to the strap.

6. The water bottle cap as recited in claim 1, wherein the tethering feature protrudes from the small ring opposite a connection between the strap and the small ring.

7. The water bottle cap as recited in claim 1, wherein the strap comprises a flared transition zone between the small ring and a substantially straight midsection of the strap, the flared transition zone having an outward flare from the midsection to the small ring at an angle in a range of about 15°-35°.

8. A water bottle cap, comprising:

a small cap portion;

a large cap portion having a spout with threads on an outer surface, wherein the small cap portion has threads that correspond to the threads of the large cap portion such that the small cap portion can be screwed onto the spout, and wherein the large cap portion has a diameter larger than a diameter of the small cap portion; and a flexible strap having a small ring on a first end and a large ring on a second end, wherein the small ring has a tethering feature and the small ring is positioned in a groove around a base of the small cap portion and the small cap portion can rotate freely while the small ring remains stationary in the groove around the base of the small cap portion, wherein the large ring is positioned in a groove around a base of the large cap portion and the large cap portion can rotate freely while the large ring remains stationary in the groove around the base of the large cap portion, wherein the tethering feature can be removably coupled to the strap and wherein the tethering feature is a loop.

9. The water bottle cap as recited in claim 8, wherein the strap has a hook that can engage the loop to removably couple the tethering feature to the strap.

10. The water bottle cap as recited in claim 8, wherein the strap has a tab adjacent the small ring, wherein the tab can engage the loop to removably couple the tethering feature to the strap.

11. The water bottle cap as recited in claim 10, wherein the strap further comprises a recessed channel and the tab is recessed within the channel.

12. The water bottle cap as recited in claim 11, wherein the loop and tab are decoupled when the small cap portion or the strap is pulled in a direction away from the tab.

13. The water bottle cap as recited in claim 11, wherein the strap further comprises a substantially flat section between the recessed channel and the large ring, wherein the substantially flat section has a length in a range of about 1.8 mm-11.8 mm.

14. A water bottle cap system, comprising:

a large cap having a spout;

a small cap configured to screw onto the spout; and a flexible strap coupling the small cap to the large cap, wherein the flexible strap has a small ring attached to a first end and a large ring attached to a second end, the small ring positioned around a base of the small cap and the large ring positioned around a base of the large cap, and wherein a tethering feature protrudes from an end of the small ring opposite the first end of the strap, the tethering feature configured to engage a corresponding feature on the strap to removably couple the small ring to the strap.

15. The water bottle cap system as recited in claim 14, wherein the tethering feature is a protrusion on a side the small ring opposite a connection between the strap and the small ring.

16. The water bottle cap system as recited in claim 15, wherein the strap has an opening configured to receive the protrusion to removably couple the tethering feature to the strap.

17. The water bottle cap system as recited in claim 15, wherein the protrusion is substantially flat and the small cap has a tab adjacent the strap, the protrusion being sized and shaped for insertion between the tab and the strap.

18. The water bottle cap system as recited in claim 14, further comprising a band around the strap, wherein the tethering feature comprises two protrusions that can be inserted between the band and the strap to couple the tethering feature to the strap.

19. A water bottle cap system, comprising:

a large cap having a spout;

a small cap configured to screw onto the spout; and a flexible strap coupling the small cap to the large cap, wherein the flexible strap has a small ring on a first end and a large ring on a second end, the small ring positioned around a base of the small cap and the large ring positioned around a base of the large cap, and wherein a tethering feature is on an end of the small ring opposite the first end of the strap, the tethering feature configured to engage a corresponding feature on the strap to removably couple the small ring to the strap and wherein the tethering feature is a loop protruding from the small ring opposite a connection between the strap and the small ring.

20. The water bottle cap system as recited in claim 19, wherein the strap has a hook that can engage the loop to removably couple the tethering feature to the strap.

21. The water bottle cap system as recited in claim 19, wherein the strap has a tab adjacent the small ring, wherein that can engage the loop to removably couple the tethering feature to the strap.

22. A method of assembling a water bottle cap system, comprising:

providing a large cap having a spout;

providing a small cap that can be screwed onto the spout;

providing a flexible strap attached to a small ring on a first end and to a large ring on a second end, wherein the small ring comprises a tethering feature configured to engage a corresponding feature to tether the small ring and small cap to the strap, wherein the tethering feature protrudes from an end of the small ring opposite the flexible strap;

positioning the small ring around a base of the small cap; and positioning the large ring around a base of the large cap.

23. A method of assembling a water bottle cap system, comprising:

providing a large cap having a spout;

providing a small cap that can be screwed onto the spout;

providing a flexible strap attached to a small ring on a first end and to a large ring on a second end, wherein the small ring comprises a tethering feature configured to engage a corresponding feature to tether the small ring and small cap to the strap, wherein the tethering feature is a loop protruding from the small ring opposite a connection between the strap and the small ring and wherein the strap has a hook that can engage the loop to removably couple the tethering feature to the strap;

positioning the small ring around a base of the small cap; and positioning the large ring around a base of the large cap.

24. The method as recited in claim 23, wherein the tethering feature is a protrusion on a side of the small ring opposite a connection between the strap and the small ring, the protrusion sized and shaped for insertion into a feature to removable couple the tethering feature to the strap.

* * * * *